US011199341B2

(12) United States Patent
Liu

(10) Patent No.: US 11,199,341 B2
(45) Date of Patent: Dec. 14, 2021

(54) HEATER

(71) Applicant: Chia-Ming Liu, Douliou (TW)

(72) Inventor: Chia-Ming Liu, Douliou (TW)

( * ) Notice: Subject to any disclaimer, the term of this patent is extended or adjusted under 35 U.S.C. 154(b) by 68 days.

(21) Appl. No.: 16/888,309

(22) Filed: May 29, 2020

(65) Prior Publication Data

US 2021/0262698 A1 Aug. 26, 2021

(30) Foreign Application Priority Data

Feb. 26, 2020 (CN) ..... 202020211212.5

(51) Int. Cl.

| | |
|---|---|
| ***F24H 9/02*** | (2006.01) |
| ***F24H 3/00*** | (2006.01) |
| ***F24C 3/14*** | (2006.01) |
| *F24H 9/20* | (2006.01) |

(52) U.S. Cl.

CPC ..... *F24H 3/006* (2013.01); *F24C 3/14* (2013.01); *F24H 9/02* (2013.01); *F24H 9/2085* (2013.01)

(58) Field of Classification Search

CPC ... F24C 3/14; F24H 3/006; F24H 9/02; F24H 9/2085; F24B 3/00; F24B 1/28

See application file for complete search history.

(56) References Cited

U.S. PATENT DOCUMENTS

| | | | | |
|---|---|---|---|---|
| 2,540,877 | A * | 2/1951 | Dow | F24H 3/006 126/93 |
| 4,512,328 | A * | 4/1985 | Arad | F24C 3/14 126/261 |
| 4,886,045 | A * | 12/1989 | Ducate, Jr. | A47J 37/0713 126/41 R |
| 6,041,769 | A * | 3/2000 | Llodra, Jr. | A47J 37/0759 126/197 |
| 7,588,026 | B2 * | 9/2009 | Ducate, Jr. | A47J 37/0713 126/25 R |
| 7,810,486 | B2 * | 10/2010 | Bruno | A47J 37/0704 126/41 R |
| 10,772,466 | B2 * | 9/2020 | O'Shaughnessy | A47J 37/0786 |
| 2006/0054160 | A1 * | 3/2006 | Borowske | F24C 3/14 126/512 |
| 2007/0163568 | A1 * | 7/2007 | Murray | F24C 3/14 126/50 |
| 2017/0159941 | A1 * | 6/2017 | Kahler | F24C 15/26 |

* cited by examiner

*Primary Examiner* — Alfred Basichas
(74) *Attorney, Agent, or Firm* — Burris Law, PLLC

(57) ABSTRACT

A heater includes short and tall cabinet units that are connected together, and an ignition unit. The short cabinet unit has a recess facing upwardly, and a first receiving space spatially communicated with the recess. The tall cabinet unit has a second receiving space spatially communicated with the first receiving space. The ignition unit includes an ignition seat disposed in the recess, an igniter mounted to the ignition seat, and a gas pipe group connected to the igniter and extending from the first receiving space into the second receiving space. A height of the short cabinet unit ranges from 45 centimeters to 60 centimeters; a height of the tall cabinet unit ranges from 65 centimeters to 70 centimeters.

10 Claims, 7 Drawing Sheets

HEATER

CROSS-REFERENCE TO RELATED APPLICATION

This application claims priority of Chinese Patent Application No. 202020211212.5, filed on Feb. 26, 2020.

FIELD

The disclosure relates to a heater, and more particularly to a gas heater.

BACKGROUND

In general, gas heaters are popularly used for heating outdoor area as they are effective and easy to operate. However, an average conventional gas heater capable of heating an open area effectively is around 2 meters in height, making it difficult to transport.

Moreover, for easy replacement of a gas cylinder of the conventional gas heater and for safety concerns, such conventional gas heater is configured in a manner that the gas cylinder is disposed at the bottom thereof, and that a heat source of the conventional gas heater is spaced above the gas cylinder. Since the shortest gas cylinder currently available on the market is around 46.5 centimeters in height, the heat source above such gas cylinder is disposed at about the height of shoulders of an average user. As a result, heating effect of the conventional gas heater via convection is limited, as hot air typically flows upward and around areas above the shoulders of the user, and is unable to warm up lower body part of the user. To make thing worse, when the user is in a sitting position, the heating effect can barely reach the user at all.

SUMMARY

Therefore, the object of the disclosure is to provide a heater that can alleviate at least one of the drawbacks of the prior art.

According to the disclosure, a heater includes a short cabinet unit, a tall cabinet unit and an ignition unit.

The short cabinet unit has a first bottom wall, a first top wall, a first surrounding wall, an opening and a first hole.

The first top wall is disposed above the first bottom wall, and is indented to form a recess that faces upwardly. The first surrounding wall is connected between a periphery of the first bottom wall and a periphery of the first top wall, and cooperates with the first bottom wall and the first top wall to define a first receiving space thereamong. The opening is formed in the first top wall, and spatially intercommunicates the recess with the first receiving space. The first hole extends through the first surrounding wall.

The tall cabinet unit has a second bottom wall, a second surrounding wall and a second hole.

The second bottom wall is disposed adjacent to and is connected to the first bottom wall. The second surrounding wall extends upwardly from a periphery of the second bottom wall, is connected to the first surrounding wall, and cooperates with the second bottom wall to define a second receiving space. The second hole extends through the second surrounding wall, and is adjacent to and registered with the first hole to communicate the first receiving space with the second receiving space.

The ignition unit includes an ignition seat, an igniter and a gas pipe group.

The ignition seat is disposed in the recess of the first top wall, and is proximate to the opening of the short cabinet unit. The igniter is disposed in the first receiving space, extends through the opening of the short cabinet unit, and is mounted to the ignition seat. The gas pipe group is connected to the igniter, and extends from the first receiving space into the second receiving space through the first and second holes.

The short cabinet unit has a height that ranges from 45 centimeters to sixty centimeters, and the tall cabinet unit has a height that ranges from 65 centimeters to 70 centimeters.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
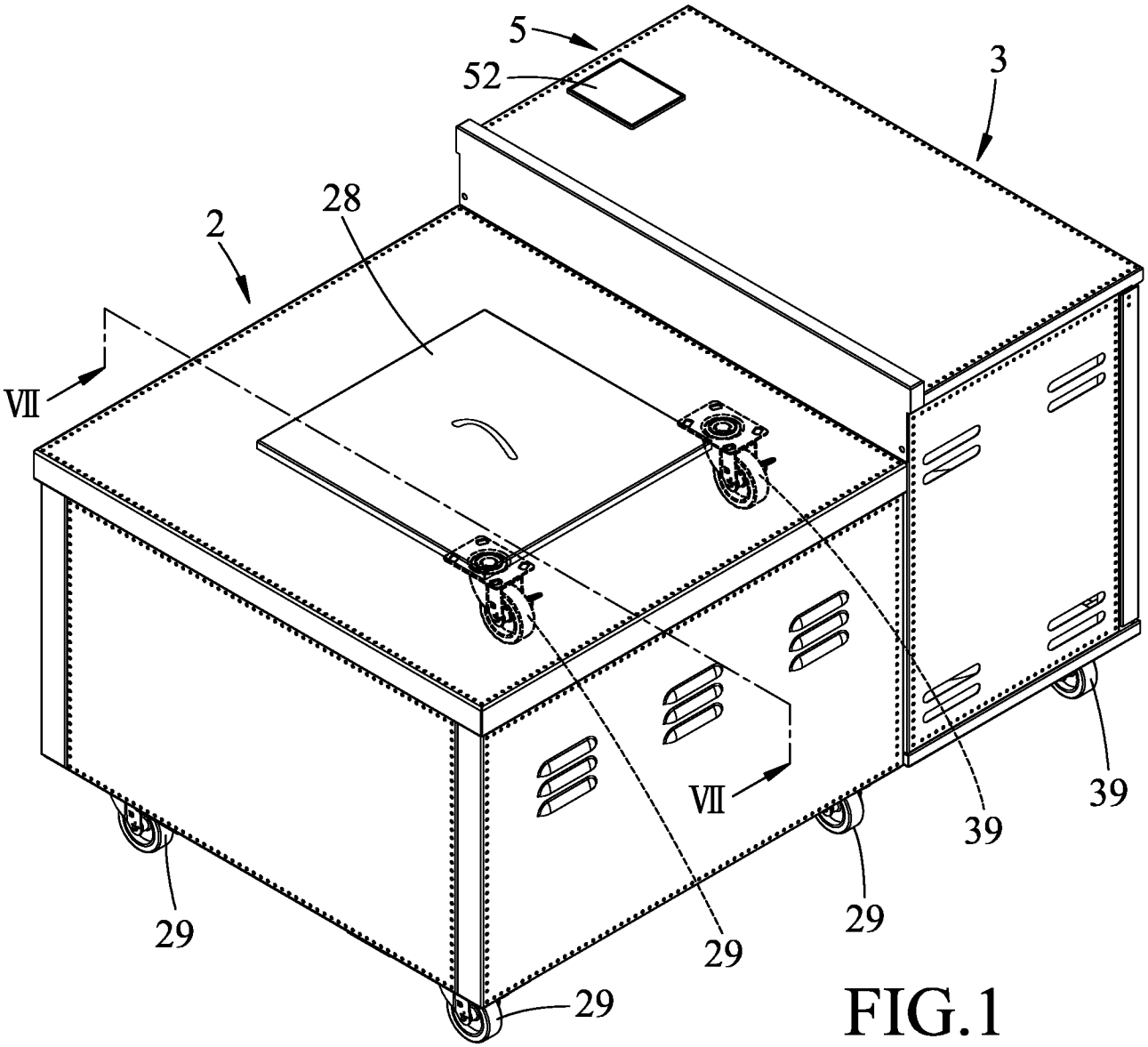
FIG. 1 is a perspective view of an embodiment of a heater according the disclosure.
Figure 2:
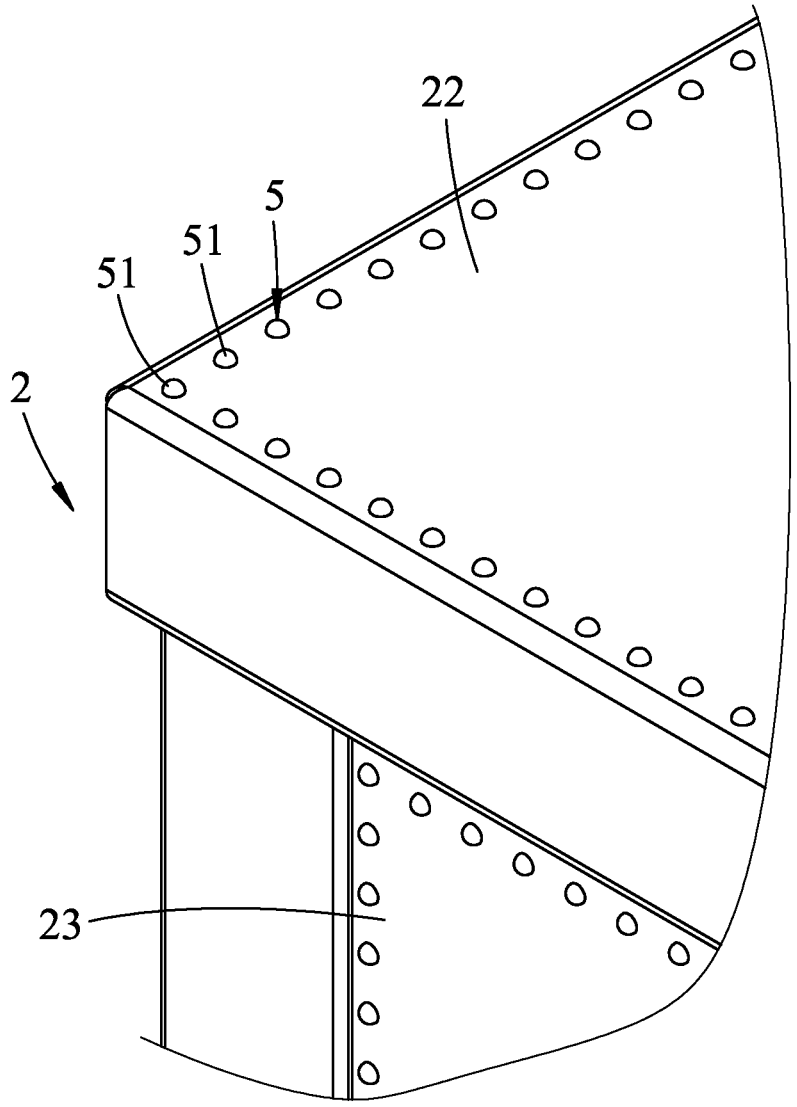
FIG. 2 is a fragmentary and enlarged perspective view of the embodiment.
Figure 3:
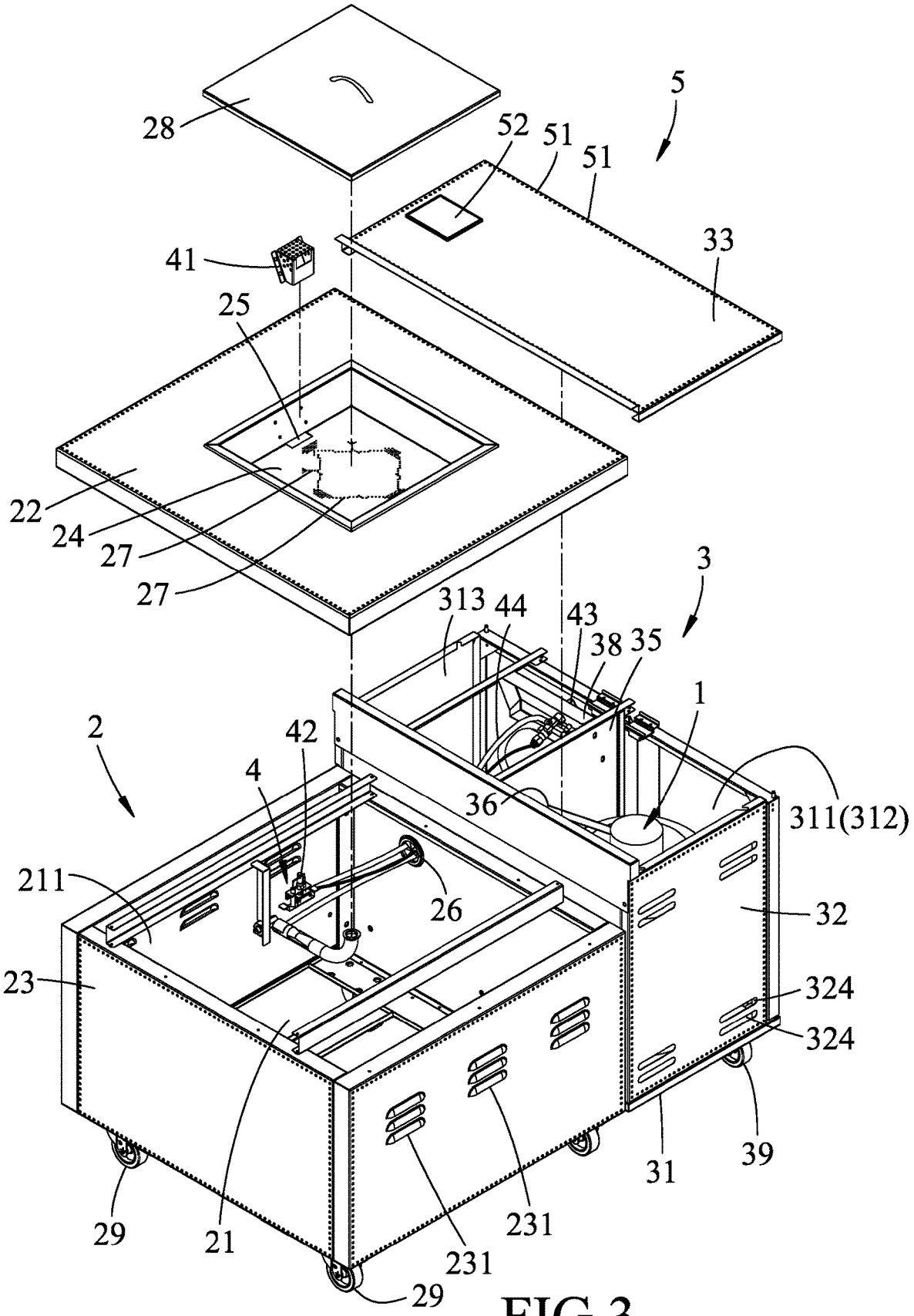
FIG. 3 is a partly exploded perspective view of the embodiment.

Referring to FIGS. 1 to 3, an embodiment of a heater according the disclosure is adapted for use with a gas cylinder 1, and a plurality of lava rocks (not shown). The heater includes a short cabinet unit 2, a tall cabinet unit 3, an ignition unit 4 and a lighting unit 5.

The short cabinet unit 2 has a first bottom wall 21, a first top wall 22, a first surrounding wall 23, a recess cover 28 and four first wheels 29.

The first top wall 22 is disposed above the first bottom wall 22, and is indented to forma recess 24 that faces upwardly and that are adapted for receiving the lava rocks.

The first surrounding wall 23 is connected between a periphery of the first bottom wall 21 and a periphery of the first top wall 22, and cooperates with the first bottom wall 21 and the first top wall 22 to define a first receiving space 211 thereamong.

The short cabinet unit 2 further has an opening 25, a first hole 26 and a plurality of gas supply holes 27. The opening 25 is formed in the first top wall 22 and spatially intercommunicates the recess 24 with the first receiving space 211. The first hole 26 extends through the first surrounding wall 23. The gas supply holes 27 are formed in the first top wall 22, and spatially intercommunicate the first receiving space 211 with the recess 24. In this embodiment, the first surrounding wall 23 is formed with a plurality of first heat dissipating holes 231 to dissipate heat out of the first receiving space 211.

The recess cover 28 is removably disposed on the first top wall 22 for covering the recess 24. The first wheels 29 are disposed under and connected to the first bottom wall 21.

The height of the short cabinet unit 2 ranges from 45 centimeters to 60 centimeters. In the present embodiment, the short cabinet unit 2 is 57 centimeters in height.

Figure 4:
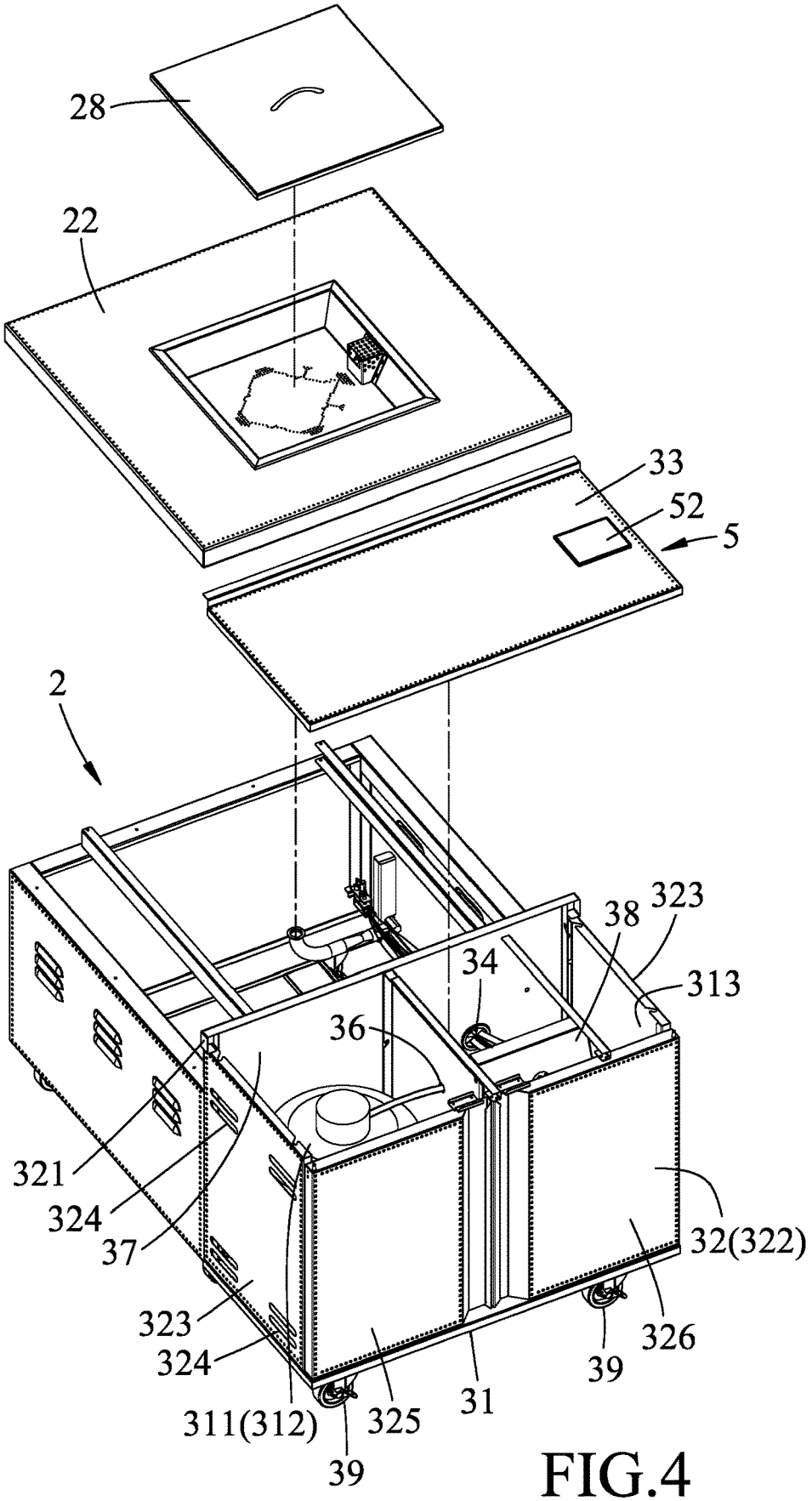
FIG. 4 is another partly exploded perspective view of the embodiment.
Figure 5:
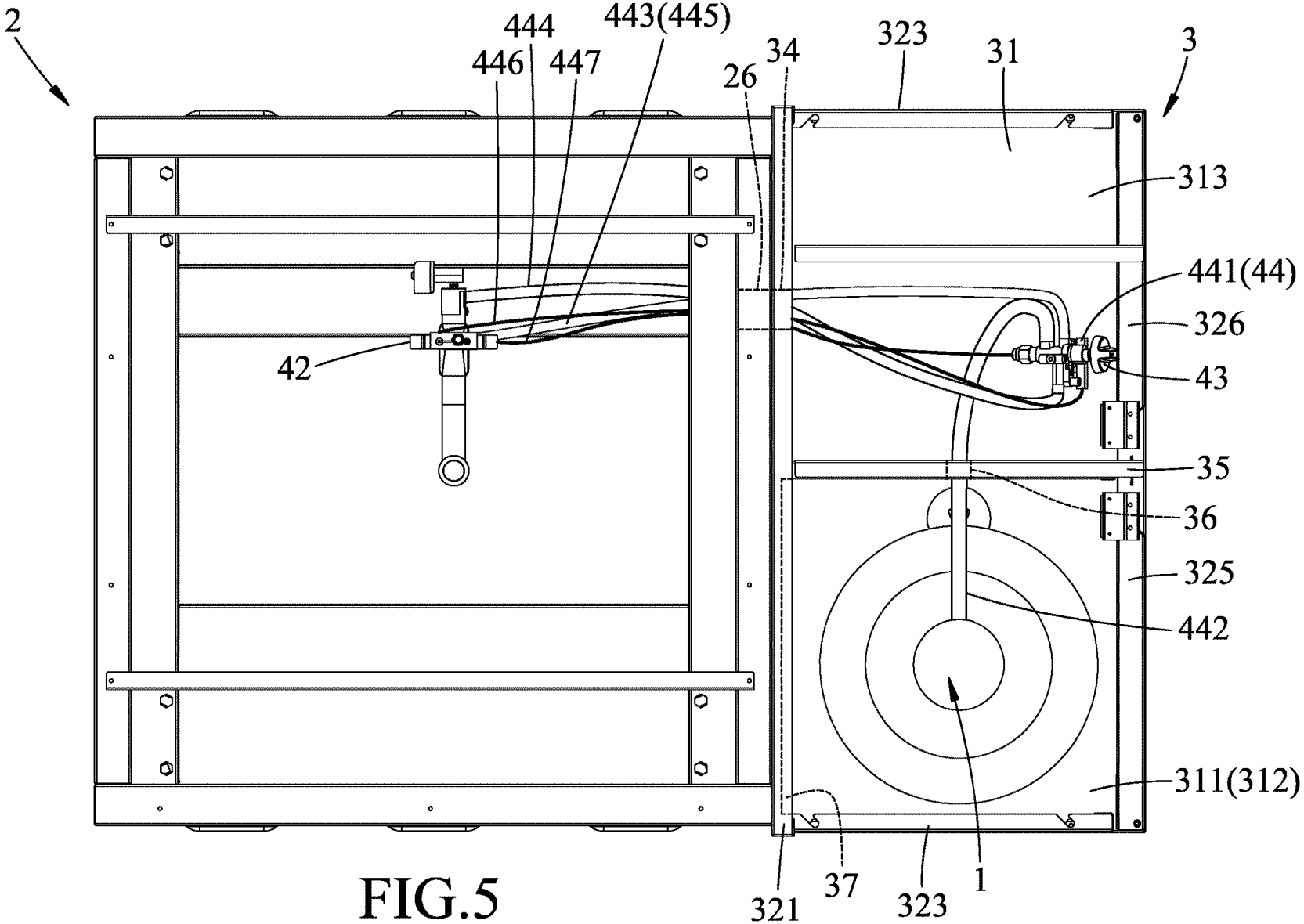
FIG. 5 is a cutaway top view of the embodiment.

Referring to FIGS. 3 to 5, the tall cabinet unit 3 has a second bottom wall 31, a second surrounding wall 32, a second top wall 33, a partition wall 35, a fireproof board 37, a support wall 38 and two second wheels 39.

The second bottom wall 31 is disposed adjacent to and is connected to the first bottom wall 22. The second surrounding wall 32 extends upwardly from a periphery of the second bottom wall 31, is connected to the first surrounding wall 23, and cooperates with the second bottom wall 31 to define a second receiving space 311. The second top wall 33 is mounted atop the second surrounding wall 32, and covers the second receiving space 311. The second surrounding wall 32 has a connecting wall portion 321, a free wall portion 322 and two extending wall portions 323. The connecting wall 321 is connected to the first surrounding wall 23. The free wall portion 322 is spaced apart from the connecting wall portion 321, and has a gas supply door 325 and a control door 326 that allow access to the second receiving space 311. The extending wall portions 323 are spaced apart from each other, and are connected between the connecting wall portion 321 and the free wall portion 322. The partition wall 35 extends upwardly from the second bottom wall 31, is disposed between the extending wall portions 323, and is connected between the connecting wall portion 321 and the free wall portion 322. The partition wall 35 divides the second receiving space 311 into a gas supply section 312 and a control section 313 that are accessible respectively via the gas supply door 325 and the control door 326.

The tall cabinet unit 3 further has a second hole 34 extending through the second surrounding wall 32, and a through hole 36 extending through the partition wall 35. Specifically, the connecting wall portion 321 of the second surrounding wall 32 is formed with the second hole 34, and the second hole 34 is adjacent to and registered with the first hole 26 to communicate the first receiving space 211 with the control section 313 of the second receiving space 311. The through hole 36 spatially intercommunicates the gas supply section 312 with the control section 313. The gas cylinder 1 is disposed in the gas supply section 312 of the second receiving space 311. One of the extending wall portions 323 of the second surrounding wall 32 next to the gas supply section 312 of the second receiving space 311 is formed with a plurality of second heat dissipating holes 324 to dissipate heat out of the gas supply section 312 of the second receiving space 311.

The fireproof board 37 is made of a fireproof material, is disposed in the gas supply section 312 of the second receiving space 311, and is connected to the connecting wall portion 321 of the second surrounding wall 32 such that the fireproof board 37 is opposite to the gas supply door 325.

The support wall 38 is disposed in the control section 313 of the second receiving space 311, and is connected to the partition wall 35. The second wheels 39 are disposed under and connected to the second bottom wall 31.

It should be noted that, FIG. 5 is a cutaway top view of the embodiment, in which the first top wall 22, the recess cover 28, the second top wall 33, the support wall 38 and other components disposed on and above the first and second top walls 22, 33 are not shown, so as to provide a clearer view of the internal structure of the heater.

The height of the tall cabinet unit 3 ranges from 65 centimeters to 70 centimeters. In the present embodiment, the tall cabinet unit 3 is 68.5 centimeters in height.

Figure 6:
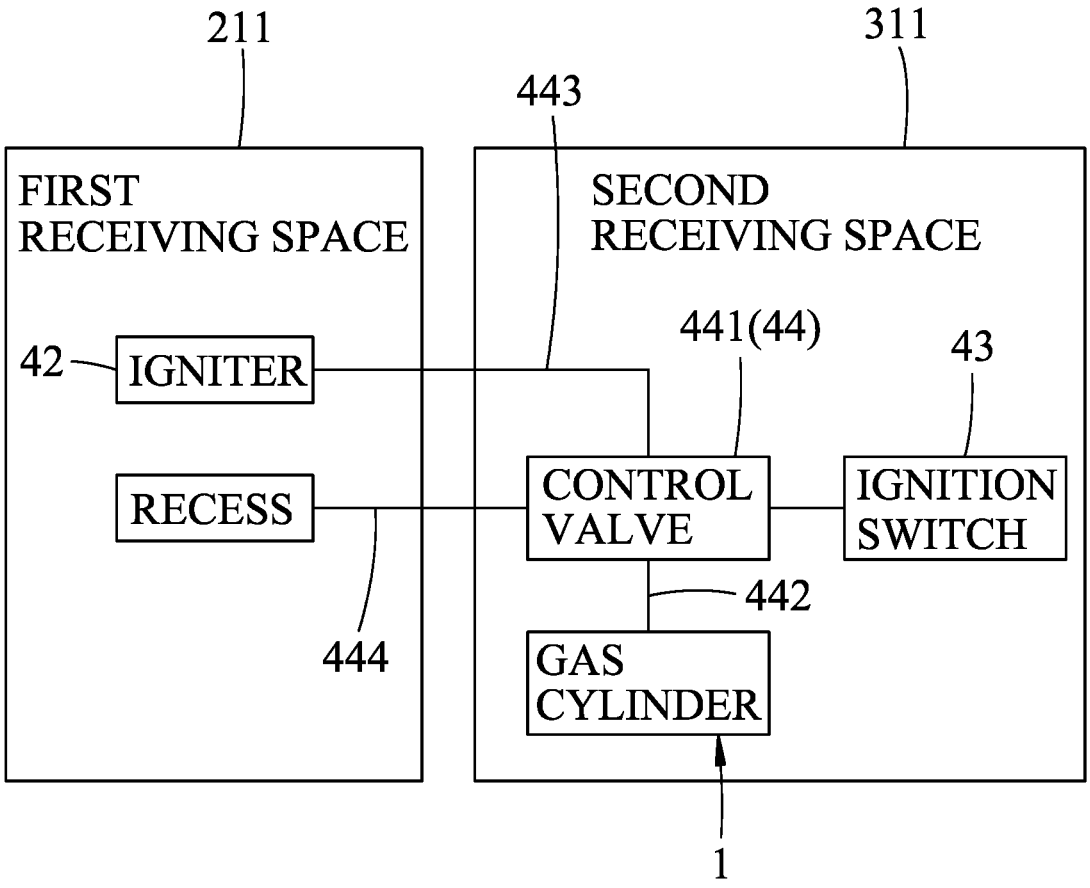
FIG. 6 is a block diagram of the embodiment, illustrating relationships among an igniter, an ignition switch, a gas pipe group and a gas cylinder.

Referring to FIGS. 3, 5 and 6, the ignition unit 4 includes an ignition seat 41, an igniter 42, an ignition switch 43 and a gas pipe group 44.

The ignition seat 41 is disposed in the recess 24 of the first top wall 22 of the short cabinet unit 2, and is proximate to the opening 25 of the short cabinet unit 2. The igniter 42 is disposed in the first receiving space 211 of the short cabinet unit 2, extends through the opening 25 of the short cabinet unit 2, and is mounted to the ignition seat 41.

The ignition switch 43 is mounted to the support wall 38 of the tall cabinet unit 3. The gas pipe group 44 is connected to the igniter 42, and extends from the first receiving space 211 into the control section 313 of the second receiving space 311 through the first and second holes 26, 34 to be connected to the ignition switch 43. From the ignition switch 43, the gas pipe group 44 further extends from the control section 313 of the second receiving space 311 into the gas supply section 312 through the through hole 36 of the partition wall 35 to be connected to the gas cylinder 1.

Specifically, the gas pipe group 44 has a control valve 441, a gas supply pipe 442, a fire-starter gas pipe module 443 and a main gas pipe module 444.

The control valve 441 is connected to the ignition switch 43. The gas supply pipe 442 is connected to the control valve 441, and extends from the control section 313 of the second receiving space 311 into the gas supply section 312 through the through hole 36 to be connected to the gas cylinder 1.

The fire-starter gas pipe module 443 extends from the control valve 441 to the igniter 42 through the second hole 34, the first hole 26 and the opening 25. The fire-starter gas pipe module 443 includes a fire-starter gas pipe 445, a high voltage line 446 and a temperature sensor line 447.

The main gas pipe module 444 extends from the control valve 441 into the first receiving space 211 through the second hole 34 and the first hole 26.

Figure 7:
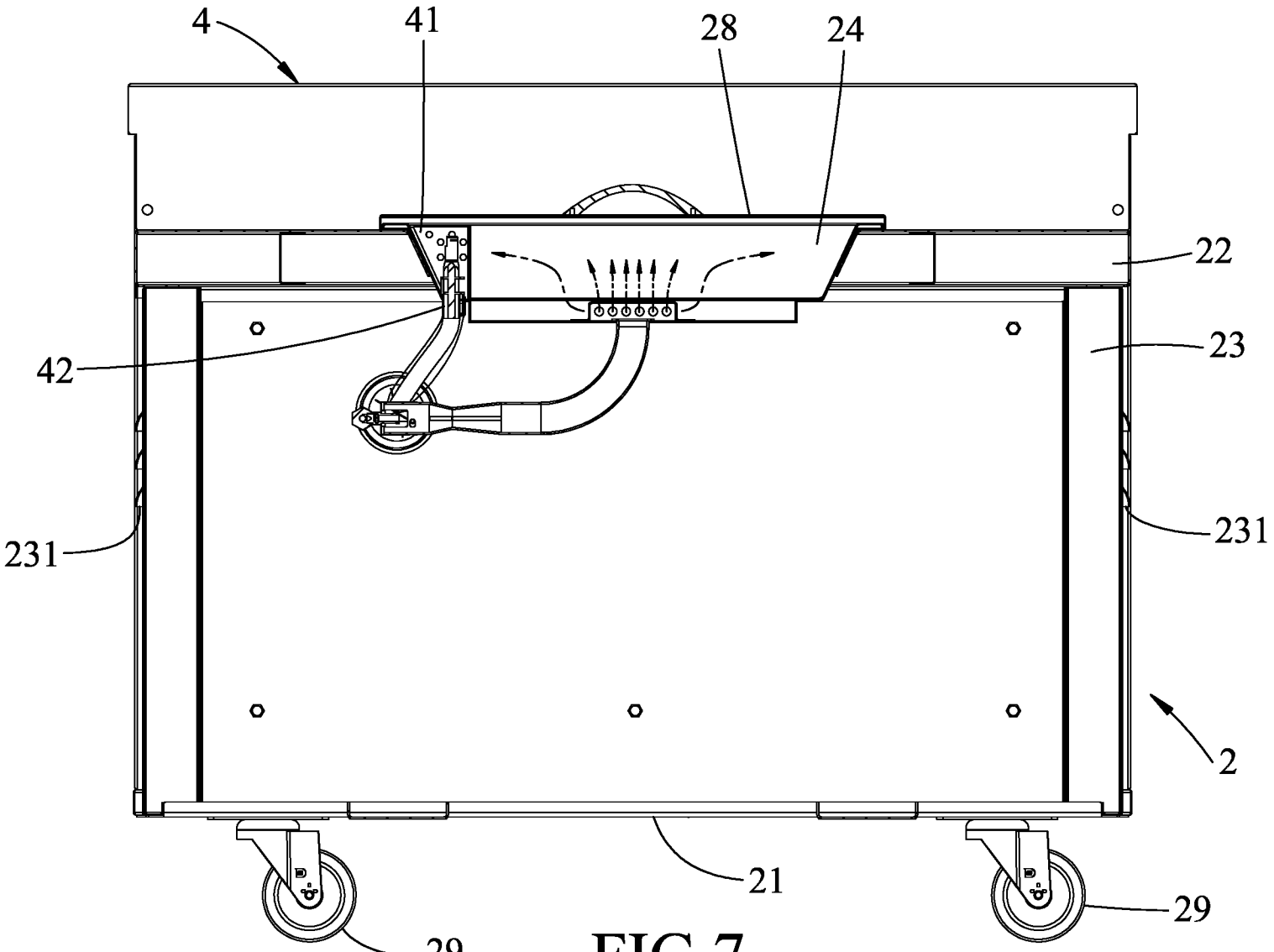
FIG. 7 is a sectional view taken along line VII-VII of FIG. 1.

Referring to FIG. 6 along with FIGS. 5 and 7, the ignition switch 43 is operable to control the control valve 441 to allow or to obstruct communication between the gas supply pipe 442 and the fire-starter gas pipe 445 of the fire-starter gas pipe module 443. When such communication is allowed, the ignition switch 43 can actuate the igniter 42 to ignite a fire by burning gas traveling from the gas cylinder 1 through the gas supply pipe 442 and the fire-starter gas pipe 445 of the fire-starter gas pipe module 443.

The ignition switch 43 is further operable to control the control valve 441 to allow or to obstruct communication between the gas supply pipe 442 and the main gas pipe module 444. When such communication is allowed, gas will travel from the gas cylinder 1, through the gas supply pipe 442 and the main gas pipe module 444, and eventually through the gas supply holes 27 into the recess 24 of the short cabinet unit 2, so as to keep the fire burning.

The lighting unit 5 includes a plurality of lightings 51 and a solar panel 52.

The lightings 51 surround and are mounted to the short and tall cabinet units 2, 3. The solar panel 52 is mounted atop the second top wall 33 for providing electric power to the lightings 51. In the present embodiment, the lightings 51 are LED lights; but are not limited thereto in other embodiments of the disclosure.

During operation, a user first opens the control door 326 to access the ignition switch 43 and start the fire, that is, the igniter 42 is actuated as mentioned above. At the same time, the ignition switch 43 is operated to allow gas to travel through the main gas pipe module 444, and into the recess 24 of the short cabinet unit 2 to keep the fire burning.

It should be noted that, in virtue of the ignition switch 43, once the fire starts burning the gas traveling through the main gas pipe module 444, the communication between the gas supply pipe 442 and the fire-starter gas pipe 445 of the fire-starter gas pipe module 443 is automatically cut off. Details of such process are known in the art and will not be described further hereinafter.

To put out the fire, the user accesses the ignition switch 43 again to obstruct the communication between the gas supply pipe 442 and the main gas pipe module 444, which in turn stops the gas from traveling to the recess 24. As a result, the fire will die out automatically.

It should be also noted that, the lava rocks disposed in the recess 24, which have been heated by the fire, will retain the heating effect for a period of time after the fire dies out. Also, the user may use the recess cover 28 to cover the recess 24 to slow down rate of heat dissipation in order to prolong the heating effect of the lava rocks.

In sum, the heater of the present disclosure has advantages as follows.

Firstly, in virtue of disposing the igniter 42 and the gas cylinder 1 separately and respectively in the short and tall cabinet units 2, 3, the recess 24 where the fire is generated can be disposed at a height lower than that of the heat source of the prior art. In other words, for the present embodiment, hot air around the heater is able to reach areas below the user's shoulders, and thus the present embodiment provides a better heating effect than does the prior art even when the user is in a sitting position.

Secondly, since the heater of the present disclosure does not exceed 70 centimeters in height, it is easier for the user to transport than is the prior art. Moreover, since both the short and tall cabinet units 2, 3 are provided with wheels (i.e. the first and second wheels 29, 39), the user can push the heater around with ease.

Thirdly, the lightings 51 mounted to the heater allows the user to easily identify the heater, especially at night, and prevents safety hazards such as accidental contact with the heater.

Finally, in virtue of the fireproof board 37 disposed in the gas supply section 312 of the tall cabinet unit 3, and the second heat dissipating holes 324 communicating the gas supply section 312 with the external environment, temperature of the gas supply section 312 is confined to be within a threshold safety range, which effectively prevents the gas cylinder 1 disposed in the gas supply section 312 from excessive heating and/or exploding.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A heater comprising:

a short cabinet unit that has a first bottom wall, a first top wall disposed above said first bottom wall, and indented to forma recess that faces upwardly, a first surrounding wall connected between a periphery of said first bottom wall and a periphery of said first top wall, and cooperating with said first bottom wall and said first top wall to define a first receiving space thereamong, an opening formed in said first top wall, and spatially intercommunicating said recess with said first receiving space, and a first hole extending through said first surrounding wall;

a tall cabinet unit that has a second bottom wall disposed adjacent to and connected to said first bottom wall, a second surrounding wall extending upwardly from a periphery of said second bottom wall, connected to said first surrounding wall, and cooperating with said second bottom wall to define a second receiving space, and a second hole extending through said second surrounding wall, and being adjacent to and registered with said first hole to communicate said first receiving space with said second receiving space; and an ignition unit that includes an ignition seat disposed in said recess of said first top wall, and being proximate to said opening of said short cabinet unit, an igniter disposed in said first receiving space, extending through said opening of said short cabinet unit, and mounted to said ignition seat, and a gas pipe group connected to said igniter, and extending from said first receiving space into said second receiving space through said first and second holes, wherein said short cabinet unit has a height that ranges from 45 centimeters to 60 centimeters, and said tall cabinet unit has a height that ranges from 65 centimeters to 70 centimeters.

2. The heater as claimed in claim 1, wherein said tall cabinet unit further has:

a partition wall that extends upwardly from said second bottom wall, and that divides said second receiving space into a gas supply section and a control section; and a through hole that extends through said partition wall, and that spatially intercommunicates said gas supply section with said control section, said gas pipe group further extending through said through hole.

3. The heater as claimed in claim 2, wherein said second surrounding wall of said tall cabinet unit has: a connecting wall portion that is connected to said first surrounding wall, and that is formed with said second hole;

a free wall portion that is spaced apart from said connecting wall portion; and two extending wall portions that are spaced apart from each other, and that are connected between said connecting wall portion and said free wall portion, said partition wall being disposed between said extending wall portions and being connected between said connecting wall portion and said free wall portion.

4. The heater as claimed in claim 3, wherein said tall cabinet unit further has a fireproof board that is made of a fireproof material, that is disposed in said gas supply section of said second receiving space, and that is connected to said connecting wall portion of said second surrounding wall.

5. The heater as claimed in claim 2, wherein:

said tall cabinet unit further has a support wall that is disposed in said control section of said second receiving space, and that is connected to said partition wall; and said ignition unit further includes an ignition switch that is mounted to said support wall and that is connected to said gas pipe group.

6. The heater as claimed in claim 5, wherein said gas pipe group has:

a control valve that is connected to said ignition switch;

a gas supply pipe that is connected to said control valve, and that extends from said control section of said second receiving space into said gas supply section through said through hole; and a fire-starter gas pipe module that extends from said control valve to said igniter through said second hole, said first hole and said opening, said ignition switch being operable to control said control valve to allow or to obstruct communication between said gas supply pipe and said fire-starter gas pipe module.

7. The heater as claimed in claim 6, wherein:

said short cabinet unit further has a plurality of gas supply holes that are formed in said first top wall and that spatially intercommunicate said first receiving space with said recess; and said gas pipe group of said ignition unit further has a main gas pipe module that extends from said control valve into said first receiving space through said second hole and said first hole, said ignition switch being further operable to control said control valve to allow or to obstruct communication between said gas supply pipe and said main gas pipe module.

8. The heater as claimed in claim 1, wherein said short cabinet unit further has a plurality of first wheels that are disposed under and connected to said first bottom wall, and said tall cabinet unit further has a plurality of second wheels that are disposed under and connected to said second bottom wall.

9. The heater as claimed in claim 1, further comprising a lighting unit that includes a plurality of lightings surrounding and being mounted to said short and tall cabinet units.

10. The heater as claimed in claim 9, wherein said tall cabinet unit further has a second top wall that is mounted atop said second surrounding wall, and said lighting unit further includes a solar panel that is mounted atop said second top wall for providing electric power to said lightings.

* * * * *